US010138040B2

(12) United States Patent
Su

(10) Patent No.: US 10,138,040 B2
(45) Date of Patent: Nov. 27, 2018

(54) TOOL HOLDER PREVENTING BEING DISMANTLED FROM A TOOL

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 84 days.

(21) Appl. No.: 14/554,125

(22) Filed: Nov. 26, 2014

(65) Prior Publication Data

US 2016/0016712 A1 Jan. 21, 2016

(30) Foreign Application Priority Data

Jul. 21, 2014 (TW) ..... 103124944 A

(51) Int. Cl.
*B65D 73/00* (2006.01)
*B65D 55/02* (2006.01)
*B25H 3/04* (2006.01)

(52) U.S. Cl.
CPC ..... *B65D 73/0064* (2013.01); *B25H 3/04* (2013.01); *B65D 55/02* (2013.01); *B65D 73/0014* (2013.01); *B65D 2211/00* (2013.01)

(58) Field of Classification Search
CPC . B25H 3/003; B25H 3/04; B25H 3/06; B65D 55/022; B65D 55/02; B65D 63/1027; B65D 73/0021; B65D 73/0014; B65D 73/005
USPC ..... 220/324
See application file for complete search history.

(56) References Cited

U.S. PATENT DOCUMENTS 5,906,350 A * 5/1999 Kao ..... A47F 7/0028 206/349
6,164,463 A * 12/2000 Lee ..... B65D 73/0014 206/376
6,315,119 B1 * 11/2001 Lee ..... B65D 73/0014 206/349
6,644,474 B1 * 11/2003 Lai ..... B25H 3/003 206/372
7,401,700 B2 * 7/2008 Dost ..... B25H 3/003 206/372

(Continued)

FOREIGN PATENT DOCUMENTS

CN 201006809 Y 1/2008
CN 201042335 Y 4/2008
TW M319241 U 9/2007

*Primary Examiner* — Robert Poon
(74) *Attorney, Agent, or Firm* — Alan D. Kamrath; Kamrath IP Lawfirm, P.A.

(57) ABSTRACT

A tool holder includes first and second holding members incorporable to form a holding space. The first holding member includes at least one restraining protrusion defining a first restraining side with a first hooking structure having a first height and a second restraining side. The second holding member includes at least one catching slot including a first limiting structure having a second height and a second limiting structure. The tool holder has a first arrangement in which the at least one first restraining protrusion engages in the at least one first catching slot, the first hooking structure engaging with the first limiting structure, as well as the second restraining side and the second limiting structure having a gap tolerance therebetween not greater than the first and second heights.

20 Claims, 13 Drawing Sheets

(56) References Cited

U.S. PATENT DOCUMENTS

| | | | | |
|---|---|---|---|---|
| 8,205,758 | B2 * | 6/2012 | Shih | A47F 7/0028 206/378 |
| 8,573,413 | B2 * | 11/2013 | Sh | B25H 3/04 211/70.6 |
| 2011/0226713 | A1 * | 9/2011 | Su | B25H 3/003 211/70.6 |

* cited by examiner

TOOL HOLDER PREVENTING BEING DISMANTLED FROM A TOOL

BACKGROUND OF THE INVENTION

1. Field of the Invention

The present invention relates to a holder and, particularly, to a tool holder preventing being dismantled from a tool.

2. Description of the Related Art

TW Patent No. M319241 shows a holder including a body and a limiting block engaging with the body to hold an object in between. The body includes two engaging slots. The limiting block is U-shaped and includes two opposite connecting extensions, which includes a plurality of primary teeth and secondary teeth individually, engaging in the two engaging slots respectively to attach to the body. Each engaging slot includes a protrusion adapted to restrain the connecting extension engaged therein from disengaging therefrom. The protrusions can be cut out, and then the limiting block is allowed to disengage from the body. However, it is still desirable to overcome a problem that the limiting block can disengage from the body accidentally and to provide a holder that has an effective anti-theft effect.

The present invention is, therefore, intended to obviate or at least alleviate the problems encountered in the prior art.

SUMMARY OF THE INVENTION

According to the present invention, a tool holder preventing being dismantled from a tool includes a first holding member and a second holding member incorporable with the first holding member to form a holding space. The first holding member has first and second ends and first and second sides extending between the first and second ends thereof. The first holding member includes at least one restraining protrusion adjacent to one of the first and second sides of the first holding member. The at least one restraining protrusion has a fixed end fixed to the first holding member and a free end opposite the fixed end. The at least one restraining protrusion includes a first edge thereof defining a first restraining side with a first hooking structure having a first height and a second edge thereof opposite the first edge defining a second restraining side. The second holding member has first and second ends and first and second sides extending between the first and second ends thereof. The second holding member includes at least one catching slot adapted to engage with the at least one restraining protrusion. The at least one first slot includes a first edge thereof including a first limiting structure having a second height and a second edge thereof opposite the first edge including a second limiting structure.

The tool holder has a first arrangement in which the first and second holding members include the holding space formed therebetween and are prevented from being separated from one another. The tool holder in the first arrangement thereof includes the first sides of the first and second holding members connecting together, and the second sides of the first and second holding members connecting together. The tool holder in the first arrangement thereof includes the at least one restraining protrusion engaging in the at least one catching slot, and the first hooking structure engaging with the first limiting structure, as well as the second restraining side and the second limiting structure having a gap tolerance therebetween not greater than the first and second heights.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an object of the present invention to provide a tool holder preventing being dismantled from a tool and of having an anti-theft effect.

Other objectives, advantages, and new features of the present invention will become apparent from the following detailed description of the invention when considered in conjunction with the accompanied drawings.

DETAILED DESCRIPTION OF THE INVENTION

Figure 1:
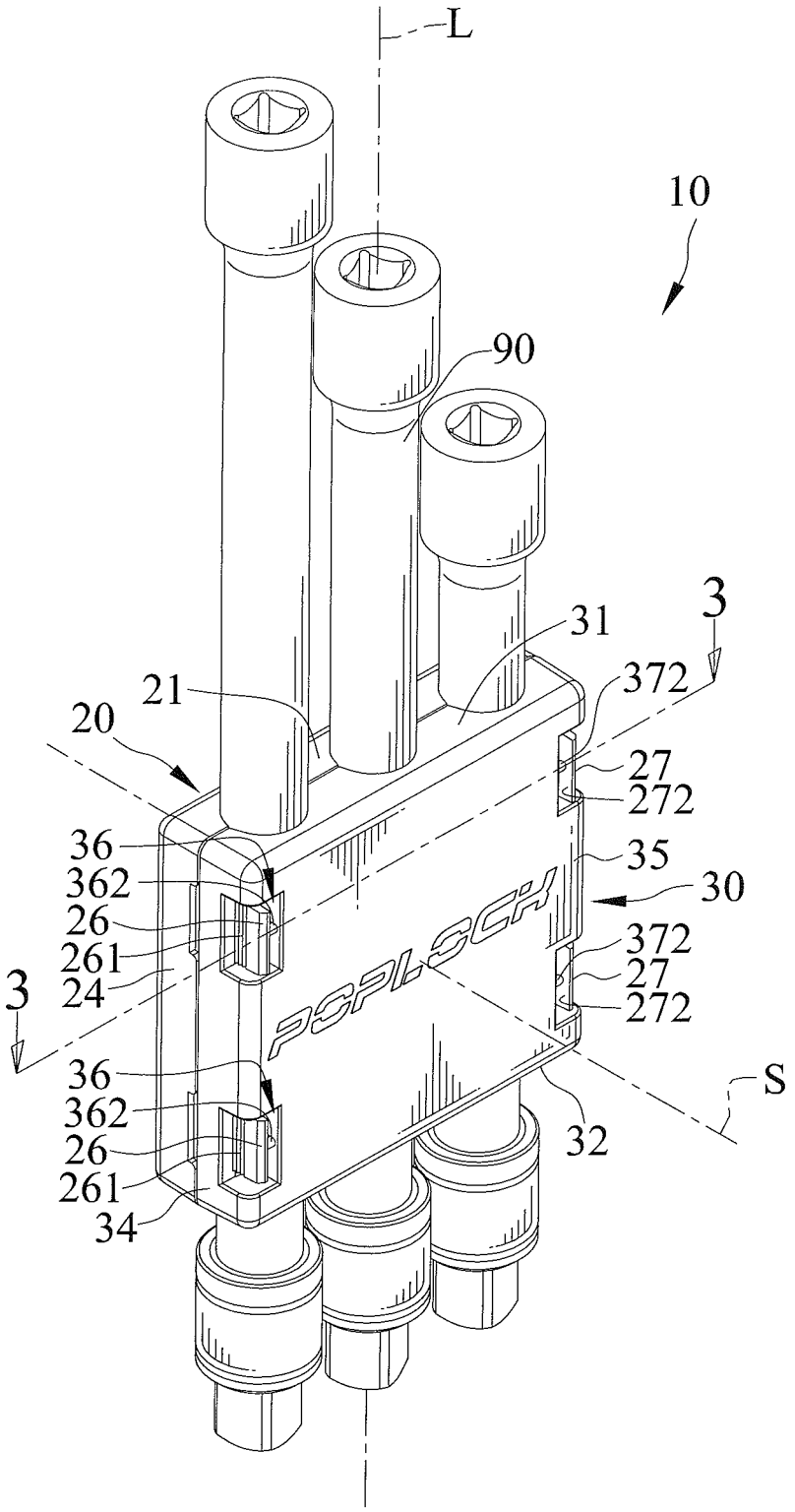
FIG. 1 is a perspective view showing a tool holder preventing being dismantled from a tool in accordance with a first embodiment of the present invention holding tools.
Figure 2:
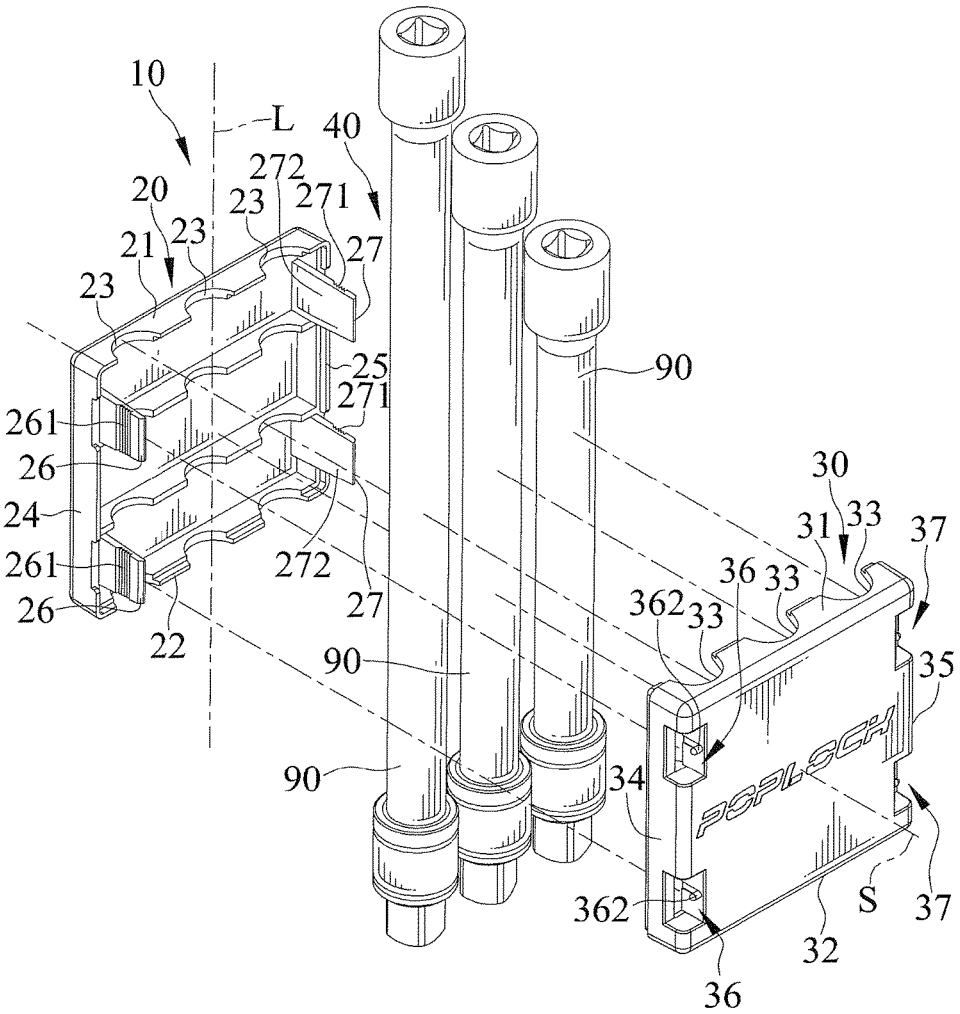
FIG. 2 is an exploded perspective view of the tool holder of the first embodiment of the present invention.
Figure 3:
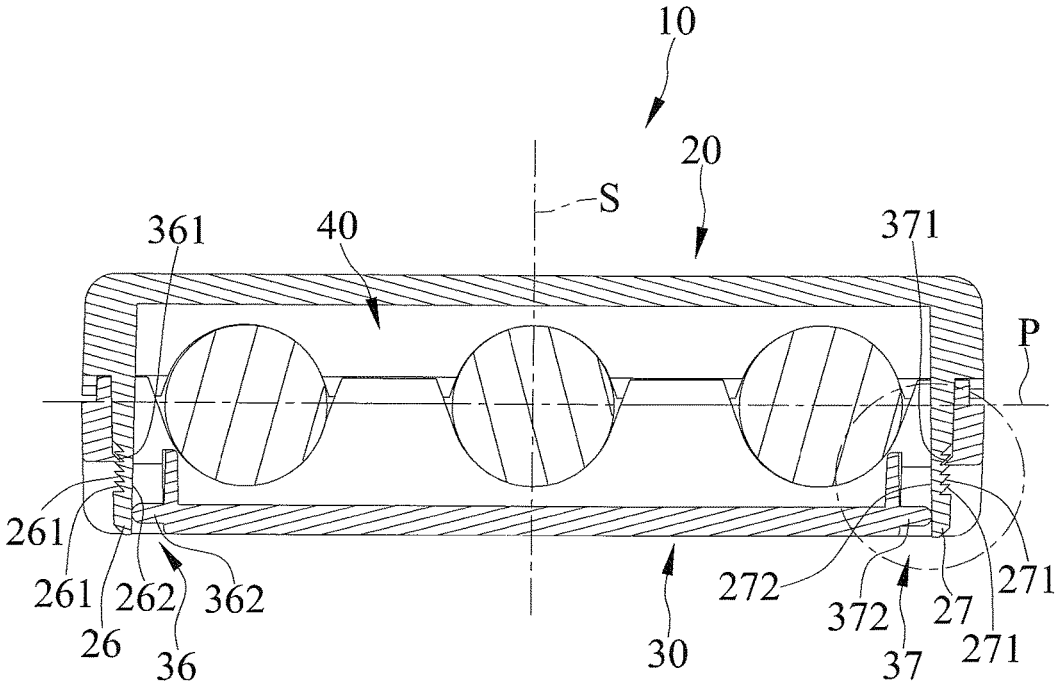
FIG. 3 is a cross-sectional view taken along line 3-3 of FIG. 1.

FIGS. 1 through 5 show a tool holder 10 preventing being dismantled from a tool in accordance with a first embodiment of the present invention. The tool holder 10 includes a first holding member 20 and a second holding member 30 incorporable with the first holding member 20 to form a holding space 40.

The first holding member 20 is made of plastic. The first holding member 20 has a first end 21 and a second end 22 distal to the first end 21 along a phantom line L which is parallel to a phantom reference plane P. The first holding member 20 includes at least one first holding recess 23. The at least one first holding recess 23 extends between the first and second ends 21 and 22 of the first holding member 20. The at least one first holding recess 23 extends through the first and second ends 21 and 22 of the first holding member 20. The tool holder 10 includes three first holding recesses 23 which are parallel to one another. The first holding member 20 has first and second sides 24 and 25 extending between the first and second ends 21 and 22 thereof. The second side 25 is distal to the first side 24 radially with respect to the phantom line L. The first holding member 20 includes a first surface extending between the first and second ends 21 and 22 thereof and between the first and second sides 24 and 25 thereof. The first holding member 20 includes at least one first restraining protrusion 26 adjacent to the first side 24 thereof. The at least one first restraining protrusion 26 extends along a phantom axis S which is perpendicular to the phantom reference plane P. The at least one first restraining protrusion 26 and 27 has a fixed end fixed to the first holding member 20 and a free end opposite the fixed end. The at least one first restraining protrusion 26 includes a first edge thereof defining a first restraining side 261 with a first hooking structure and a second edge thereof opposite the first edge defining a second restraining side 262. The first hooking structure has a first height H1. The first hooking structure is configured to include a plurality of first teeth. The plurality of first teeth is disposed one after another along a longitudinal direction of the first restraining side 261. The fixed end and the free end of the first restraining side 261 are distal from one another in the longitudinal direction of the first restraining side 261. The first side 24 of the first holding member 20 extends longitudinally parallel to the longitudinal direction of the first restraining side 261. The at least one first restraining protrusion 26 has a greater longitudinal length than the first side 24 of the first holding member 20. The first height H1 is measured in a direction radial with respect to the longitudinal direction of at least one first restraining protrusion 26. The first height H1 is measured between top and bottom lands of each of the plurality of first teeth. The bottom land of each of the plurality of first teeth is disposed on the first edge of the first restraining side 261 and distal to the top land of each of the plurality of first teeth. Each of the plurality of first teeth is tapered from the bottom land to the top land thereof. Each of the plurality of first teeth has a face width measured along the phantom line L. The at least one first restraining protrusion 26 includes two first restraining protrusions 26.

In addition, the first holding member 20 includes at least one second restraining protrusion 27 similar to the at least one first restraining protrusion 26, except that the at least one second restraining protrusion is adjacent to the second side 25 of the first holding member. Likewise, the at least one second restraining protrusion 27 includes two second restraining protrusions 27.

Furthermore, the first holding member 20 and the at least one first and second restraining protrusions 26 and 27 are made in one piece.

The second holding member 30 is made of plastic. The second holding member 30 is incorporable with the first holding member 20 to form the holding space 40. The second holding member 30 has a first end 31 and a second end 32 distal to the first end 31 along the phantom line L. The second holding member 30 includes at least one second holding recess 33 incorporable with the at least one first holding recess 23. The at least one second holding recess 33 extends between the first and second ends 31 and 32 of the second holding member 30. The at least one second holding recess 33 extends through the first and second ends 31 and 32 of the second holding member 30. The tool holder 10 includes three second holding recesses 33 which are parallel to one another. The second holding member 30 has first and second sides 34 and 35 extending between the first and second ends 21 and 22 thereof. The second side 35 is distal to the first side 34 radially with respect to the phantom line L. The second holding member 30 includes a second surface extending between the first and second ends 31 and 32 thereof and between the first and second sides 34 and 35 thereof. The second and first surfaces have substantially equal dimensions. The second holding member 30 includes at least one first catching slot 36 adapted to engage with the at least one first restraining protrusion 26. The at least one first catching slot 36 includes a first edge thereof including a first limiting structure 361 and a second edge thereof opposite the first edge including a second limiting structure 362. The first limiting structure 361 is configured to include a ridge. The second limiting structure 362 is configured to include a protuberance. The first limiting structure 361 has a second height 112. The second height H2 equals to the first height H1. The second height 112 is measured between the top and the root of the ridge. The root of the ridge is disposed on the first edge of the at least one first catching slot 36. The at least one first catching slot 36 includes two first catching slots 36.

In addition, the second holding member 30 includes at least one second catching slot 37 similar to the at least one first catching slot 36, except that the at least one second catching slot 37 is adjacent to the second side 35 of the second holding member 30. Likewise, the at least one second catching slot 37 includes two second catching slots 37.

The tool holder 10 has a first arrangement in which the first and second holding members 20 and 30 include the holding space 40 formed therebetween and are prevented from being separated from one another. The tool holder 10 in the first arrangement thereof includes the first sides 24 and 34 of the first and second holding members 20 and 30 connecting together, and the second sides 25 and 35 of the first and second holding members 20 and 30 connecting together. Moreover, the tool holder 10 in the first arrangement thereof includes the at least one first restraining protrusion 26 engaging in the at least one first catching slot 36, and the at least one second restraining protrusion 27 engaging in the at least one second catching slot 37. Moreover, the tool holder 10 in the first arrangement thereof includes the first hooking structure engaging with the first limiting structure 361. Therefore, the ridge protrudes and is disposed in a gap between two adjacent first teeth of the plurality of first teeth. Moreover, the tool holder 10 in the first arrangement thereof includes the restraining side structure and the second limiting structure 362 having a gap tolerance G therebetween not greater than first and second heights H1 and H2. Moreover, the tool holder 10 in the first arrangement thereof includes the first and second holding recesses 23 and 33 thereof incorporating together and delimiting a holding compartment disposed within the holding space 40. Moreover, the tool holder 10 in the first arrangement thereof includes the first surface opposite the second surface.

Figure 4:
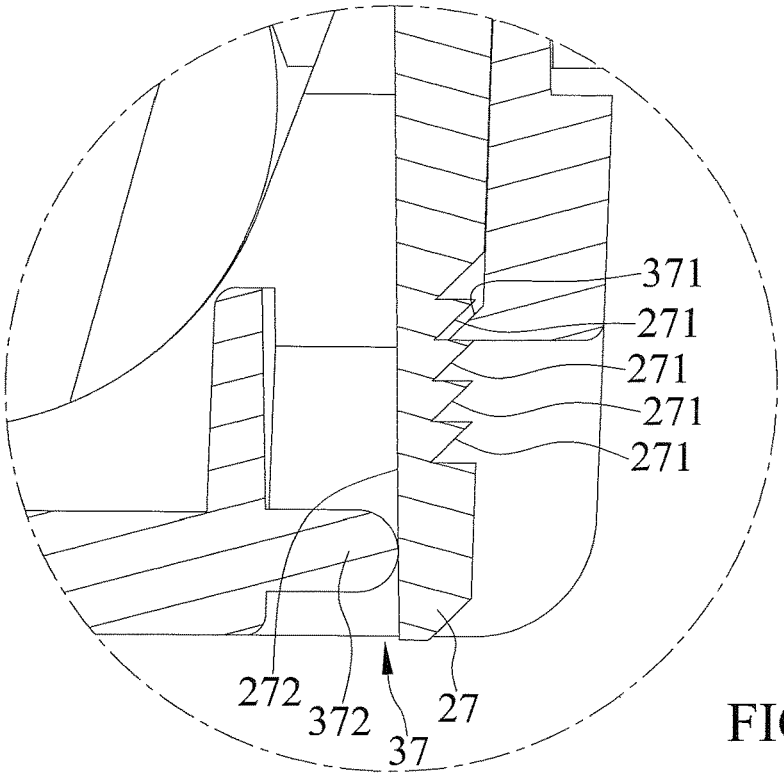
FIG. 4 is an enlarged cross-sectional view of FIG. 3.

Furthermore, the tool holder 10 in the first arrangement thereof includes the first hooking structure on the first restraining side 271 engaging with the first limiting structure 371, as shown in FIG. 4. The first hooking structure on the first restraining side 271 and the first limiting structure 371 are prevented from disengagement, since the second limiting structure 372 counters the first hooking structure on the first restraining side 271 being moved in a direction away from the first limiting structure 371. FIG. 4 shows the second limiting structure 372 abuts against the second restraining side 272.

Figure 5:
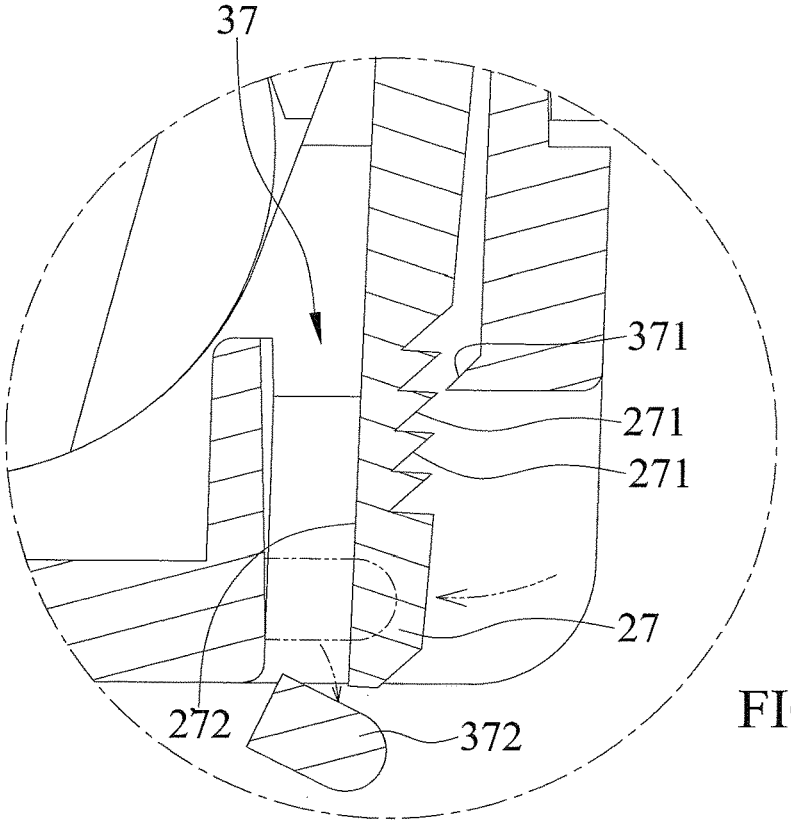
FIG. 5 is a partial, enlarged cross-sectional view showing an abutting member of the tool holder of the first embodiment of the present invention being removed in order to dismantle the tool holder.
Figure 6:
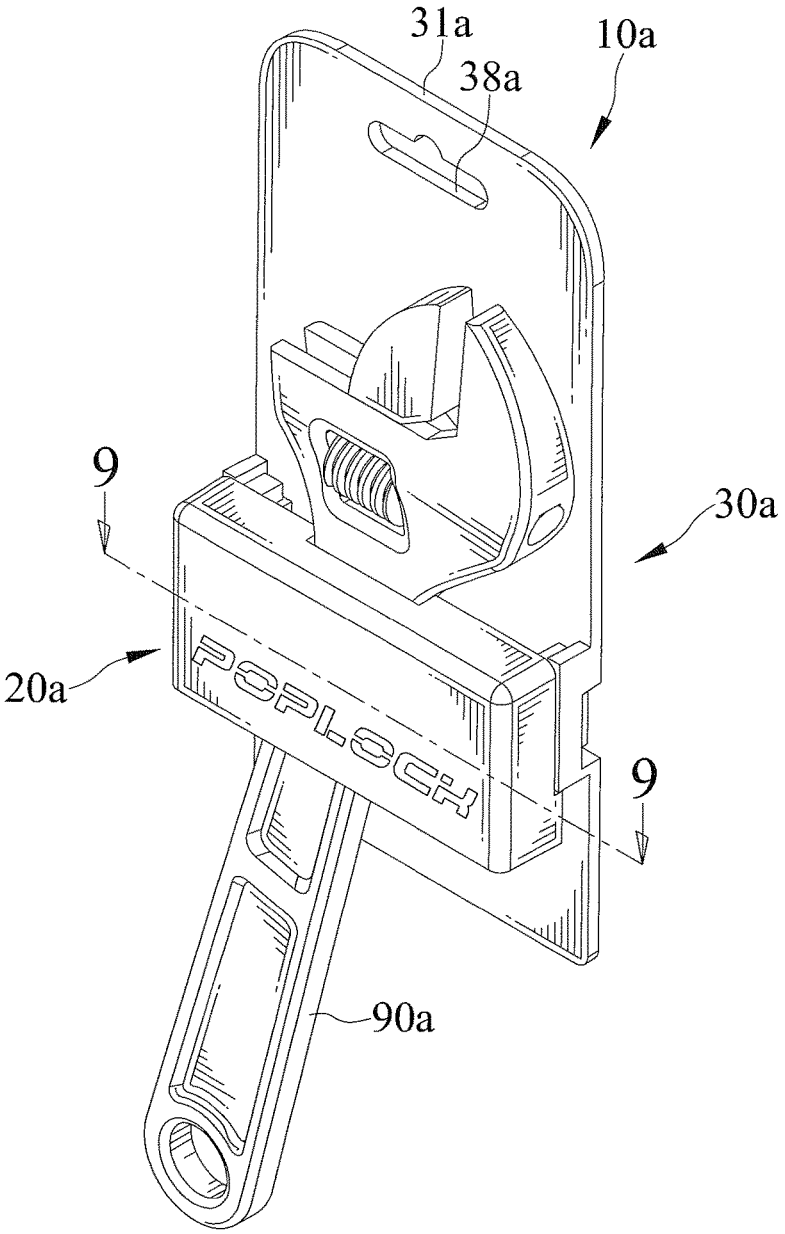
FIG. 6 is a perspective view showing a tool holder preventing being dismantled from a tool in accordance with a second embodiment of the present invention holding a tool.
Figure 7:
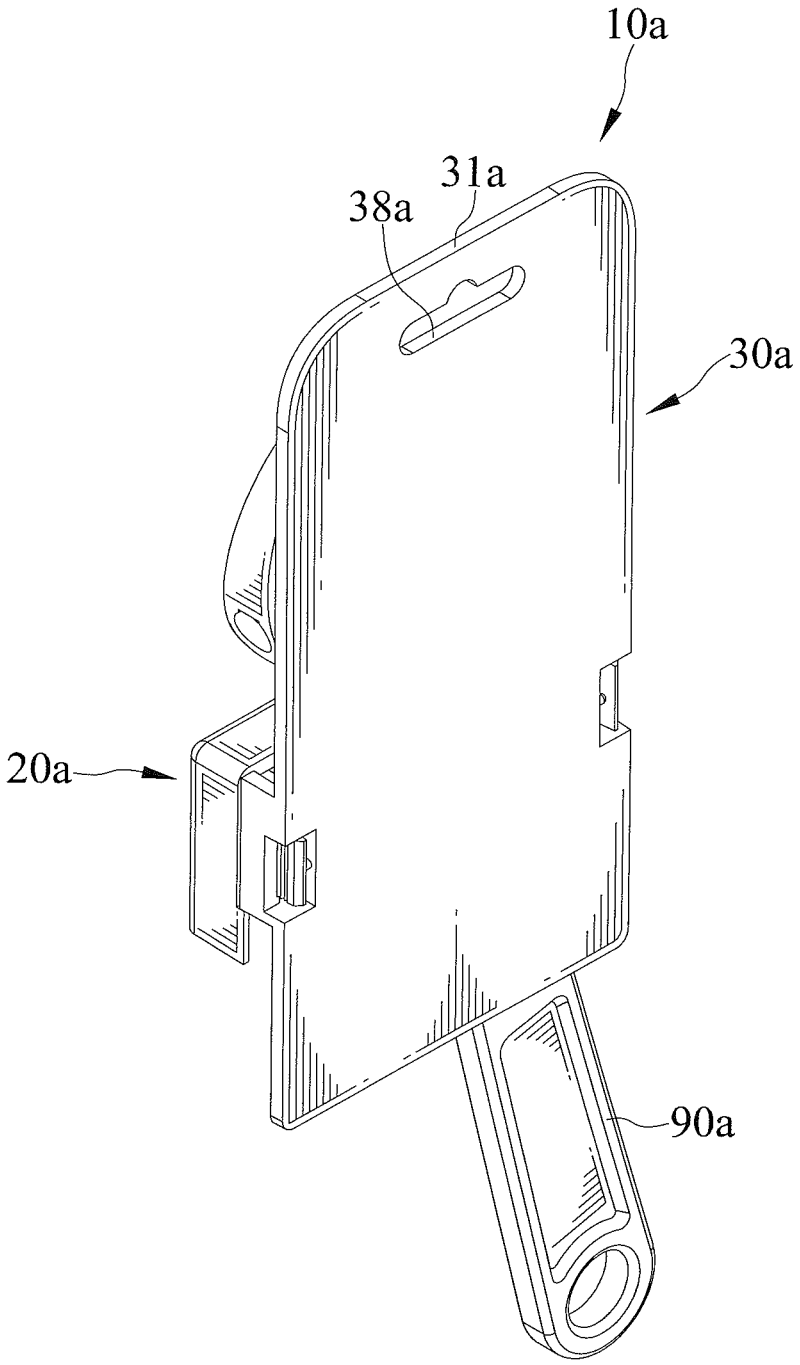
FIG. 7 is another perspective view of the tool holder of the second embodiment of the present invention, but from an angle of view different from that of FIG. 6.
Figure 8:
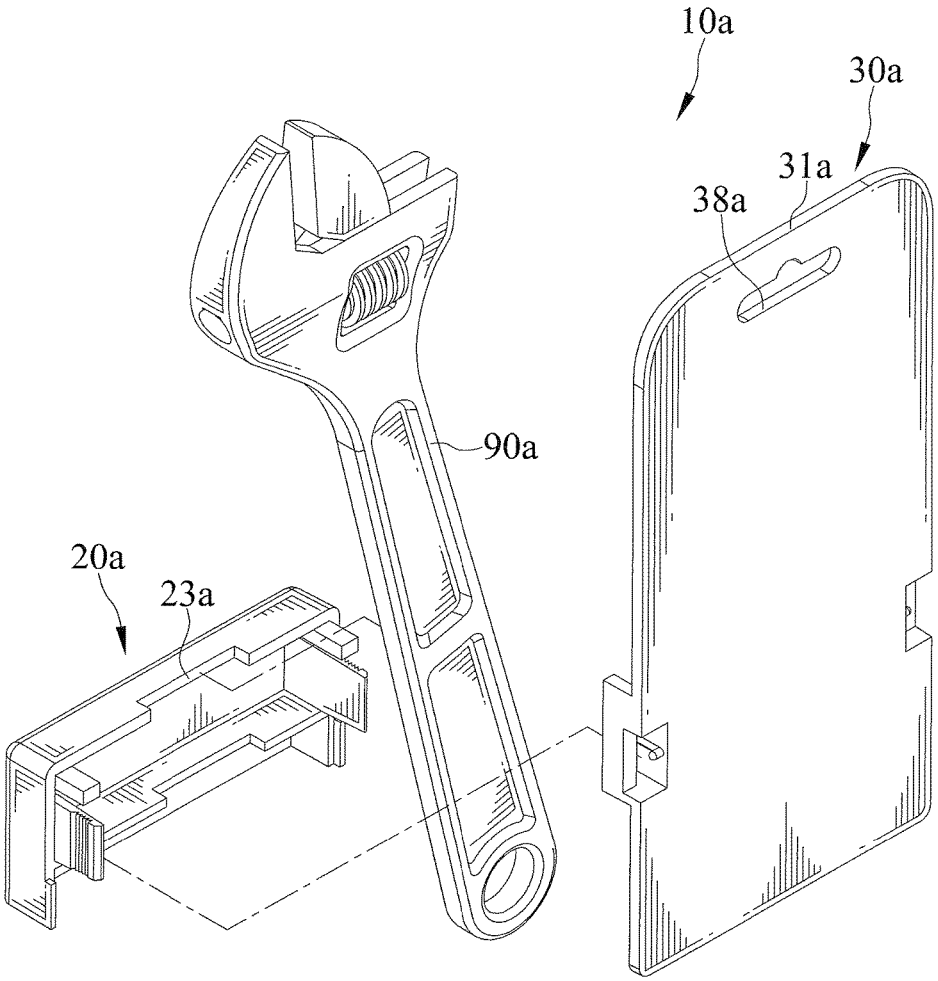
FIG. 8 is an exploded perspective view of the tool holder of the second embodiment of the present invention.
Figure 9:
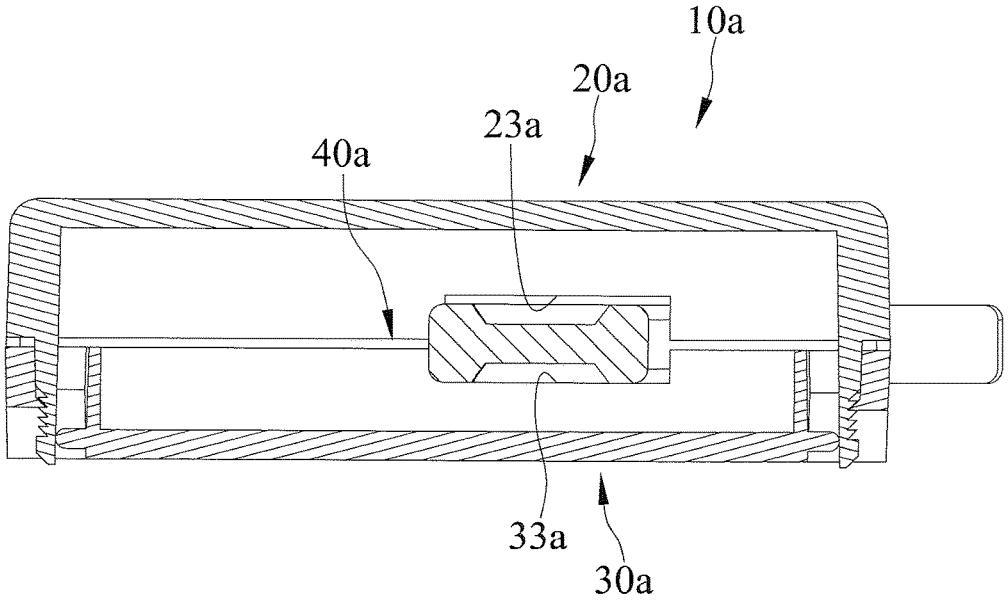
FIG. 9 is a cross-sectional view taken along line 9-9 of FIG. 6.

In order to separate the first and second holding members 20 and 30, the second limiting structures 362 and 372 are cut short first, and then the second restraining side 262 and the second limiting structure 362 have a gap tolerance therebetween greater than the heights of the first hooking structure on the first restraining side 261 and of the first limiting structure 361, and the second restraining side 272 and the second limiting structure 372 have a gap tolerance therebetween greater than the heights of the first hooking structure on the first restraining side 271 and of the first limiting structure 371. Therefore, the first hooking structure on the first restraining side 261 and the first limiting structure 361 can be disengaged from one another, and the hooking structure on the first restraining side 271 and the first limiting structure 371 can be disengaged from one another, too. Alternatively, the second limiting structures 362 and 372 can be cut off, as shown in FIG. 5, to allow the first hooking structure on the first restraining side 261 and the first limiting structure 361 to be disengaged from one another, and the hooking structure on the first restraining side 271 and the first limiting structure 371 to be disengaged from one another.

FIGS. 6 through 9 show a tool holder 10*a* preventing being dismantled from a tool in accordance with a second embodiment of the present invention, and same numbers are used to correlate similar components of the first embodiment, but bearing a letter a. The tool holder 10*a* includes first and second holding members incorporable to form a holding space 40*a*. The first holding member 20 includes at least one first holding recess 23*a*. The at least one first holding recess 23*a* extends between first and second ends of the first holding member 20*a*. The at least one first holding recess 23*a* extends through the first and second ends of the first holding member 20*a*. The second holding member 30*a* includes at least one second holding recess 33*a* incorporable with the at least one first holding recess 23*a*. The at least one second holding recess 33*a* extends between first end 31*a* and the second end of the second holding member 30*a*. The at least one second holding recess 33*a* extends through the first end 31 and the second end of the second holding member 30*a*. The tool holder 10*a* is similar to the tool holder 10, except that the first holding member 20*a* has a shape different from that of the first holding member 20, and the second holding member 30*a* has a shape different from that of the second holding member 30. A hanging structure 38*a* is disposed on the second holding member 30*a*. The hanging structure 38*a* is in a form of a hang hole, which extends through the second holding member 30*a*. In addition, the first holding member 20*a* includes a first surface extending between the first and second ends thereof and between the first and second sides thereof, and the second holding member 30*a* includes a second surface extending between the first and second ends thereof and between the first and second sides thereof and having a greater area than the first surface.

Figure 10:
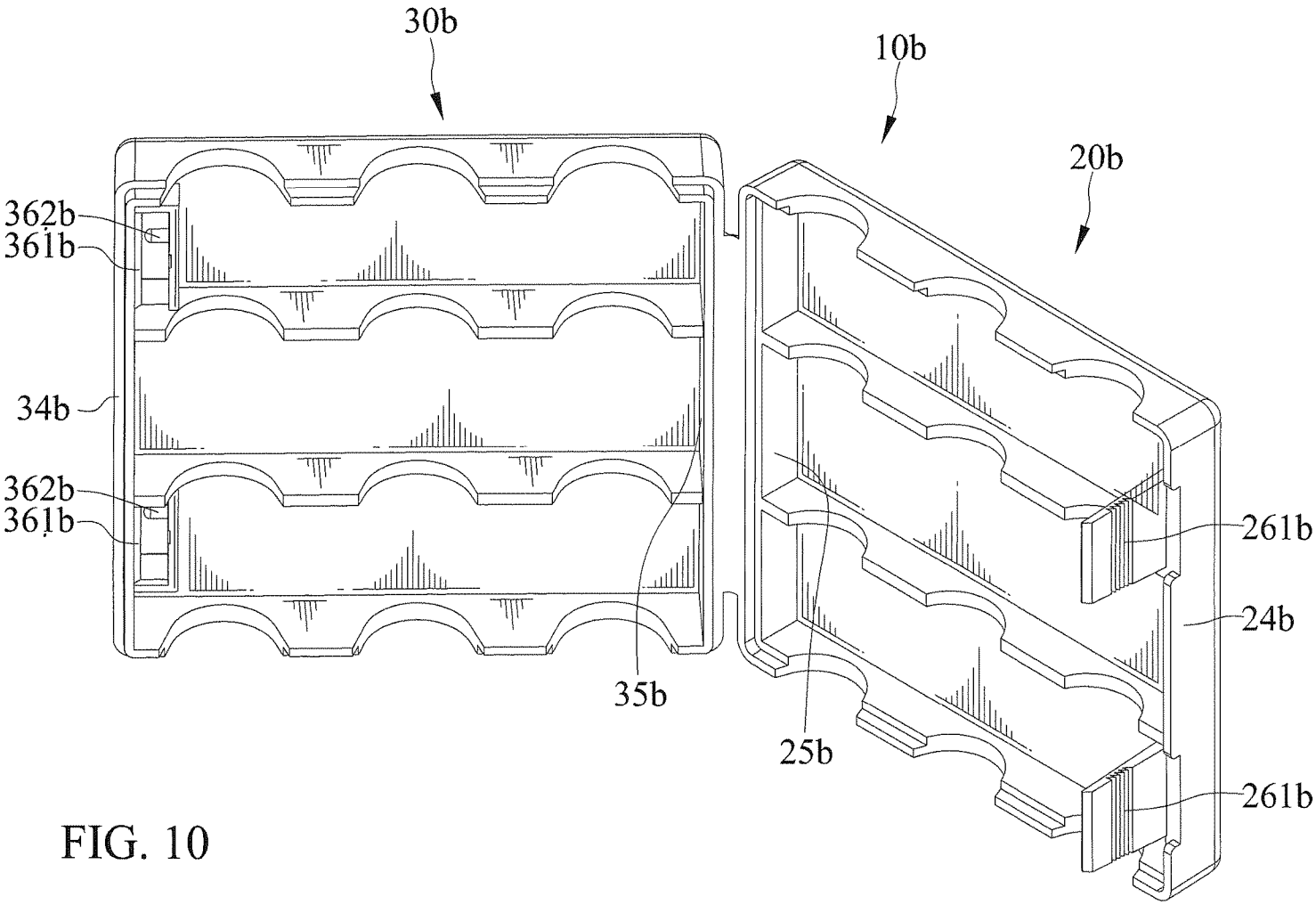
FIG. 10 is a cross-sectional view showing a tool preventing being dismantled from a tool in accordance with a third embodiment of the present invention.
Figure 11:
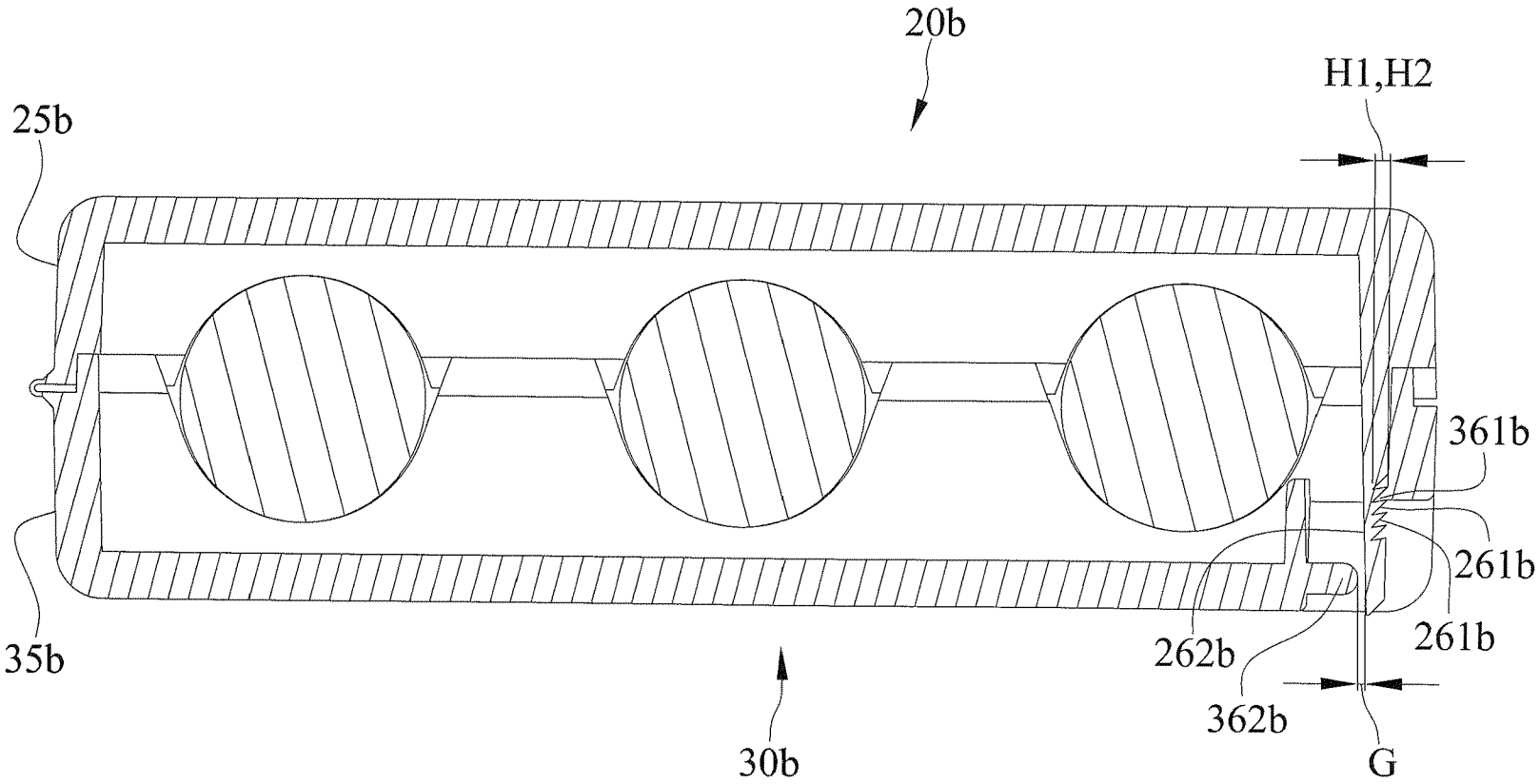
FIG. 11 is a cross-sectional view showing the tool holder of the third embodiment of the present invention holding tools.

FIGS. 10 and 11 show a tool holder 10*b* preventing being dismantled from a tool in accordance with a third embodiment of the present invention, and same numbers are used to correlate similar components of the first embodiment, but bearing a letter b. The tool holder 10*b* includes first and second holding members 20*b* and 30*b* incorporable to form a holding space. The first holding member 20*b* has first and second sides 24*b* and 25*b* extending between first and second ends thereof. The second holding member 30*b* has first and second sides 34*b* and 35*b* extending between the first and second sends thereof. At least one first restraining protrusion includes a first edge thereof defining a first restraining side 261*b* with a first hooking structure and a second edge thereof opposite the first edge defining a second restraining side 262*b*. At least one first catching slot includes a first edge thereof including a first limiting structure 361*b* and a second edge thereof opposite the first edge including a second limiting structure 362*b*. The tool holder 10*b* is similar to the tool holder 10, except that the tool holder 10*b* includes first and second holding members 20*b* and 30*b* pivotally connecting to one another. The second side 25*b* of the first holding member 20*b* and the second side 35*b* of the second holding member 30*b* include an extension extending therebetween. The extension allows the first holding member 20*b* to pivotally connect to the second holding member 30*b*. The first and second holding members 20*b* and 30*b* and the extension are made in one piece.

Figure 12:
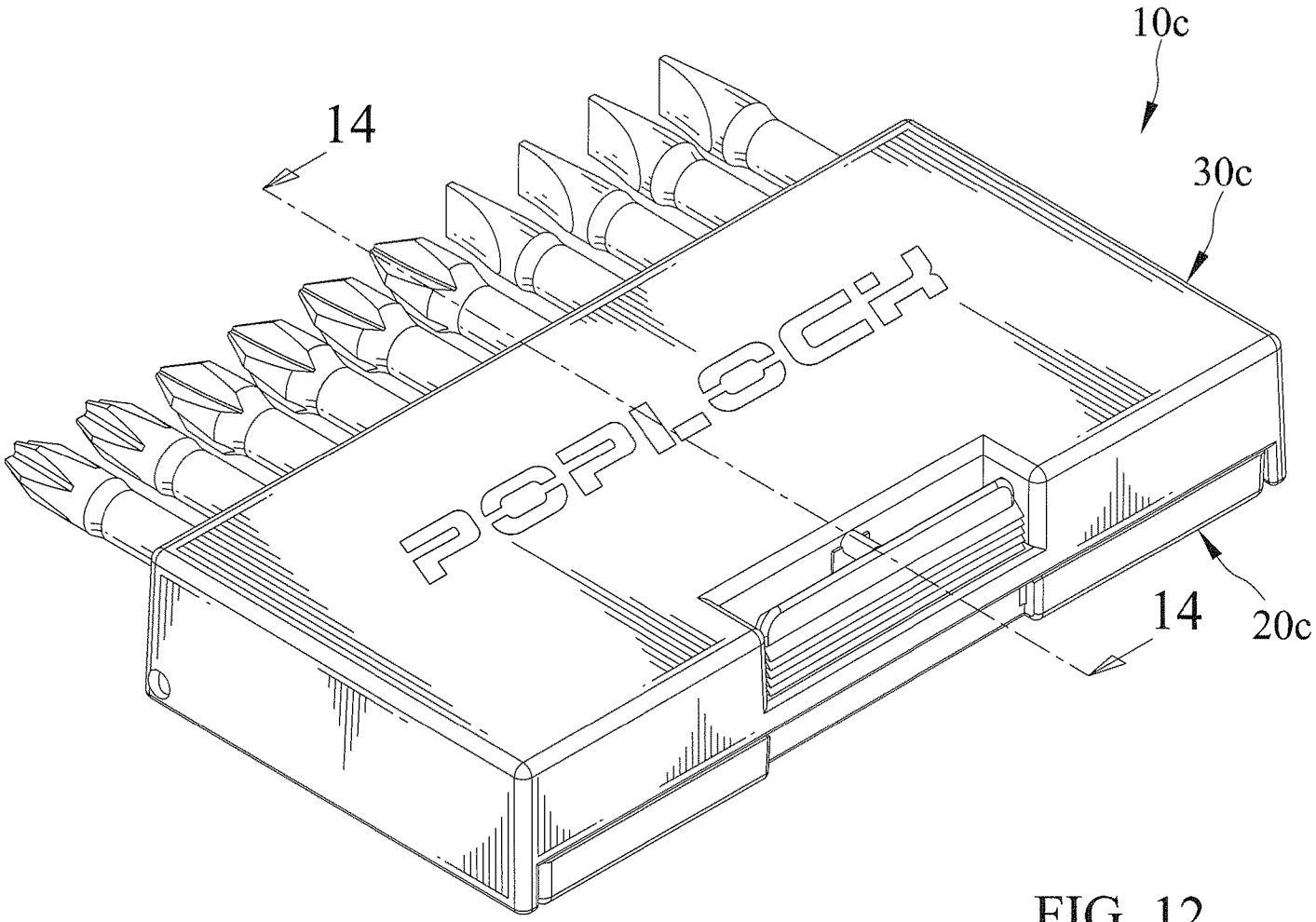
FIG. 12 is a perspective view showing a tool holder preventing being dismantled from a tool in accordance with a fourth embodiment of the present invention holding tools.
Figure 13:
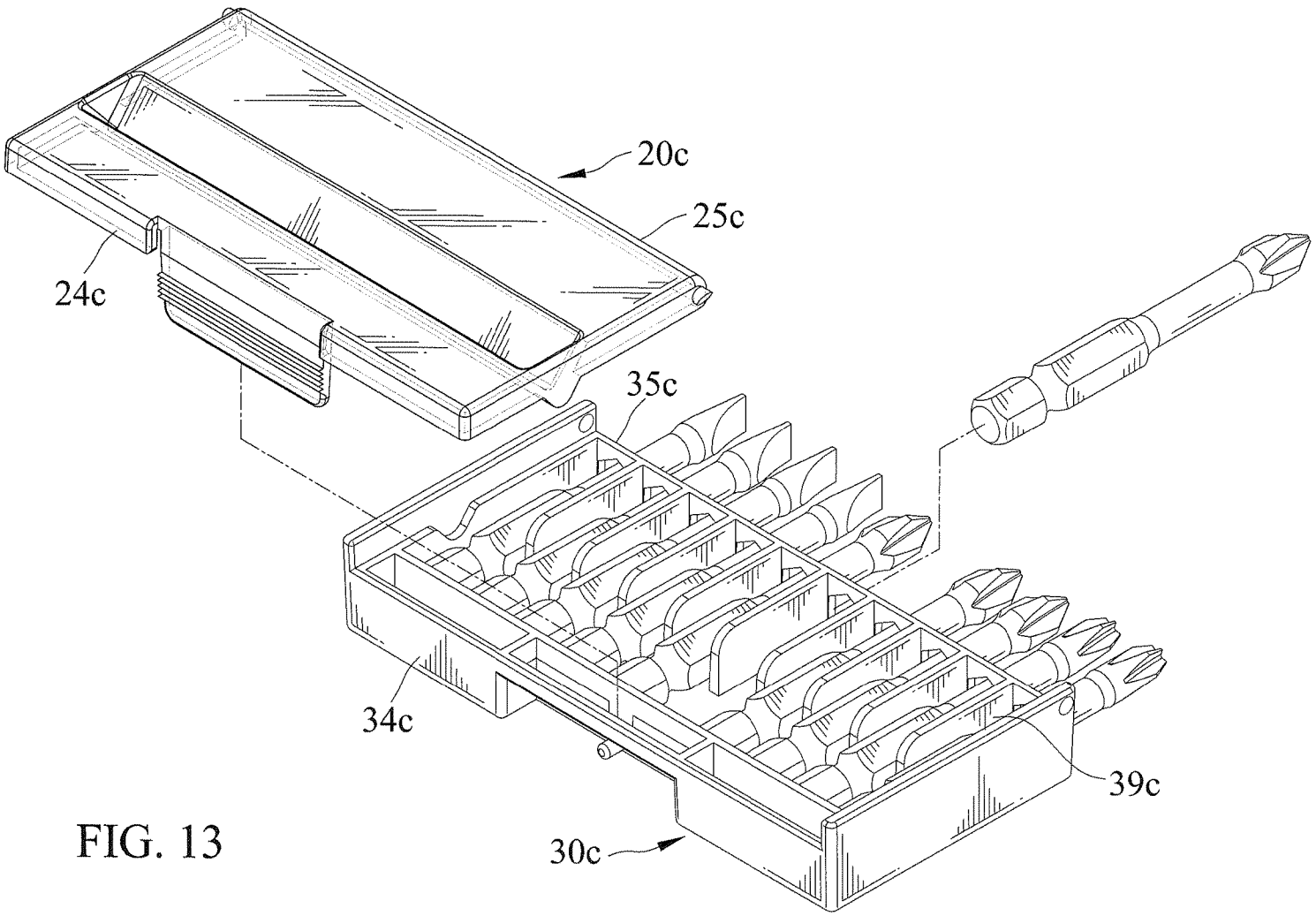
FIG. 13 is an exploded perspective view of the fourth embodiment of the present invention.
Figure 14:
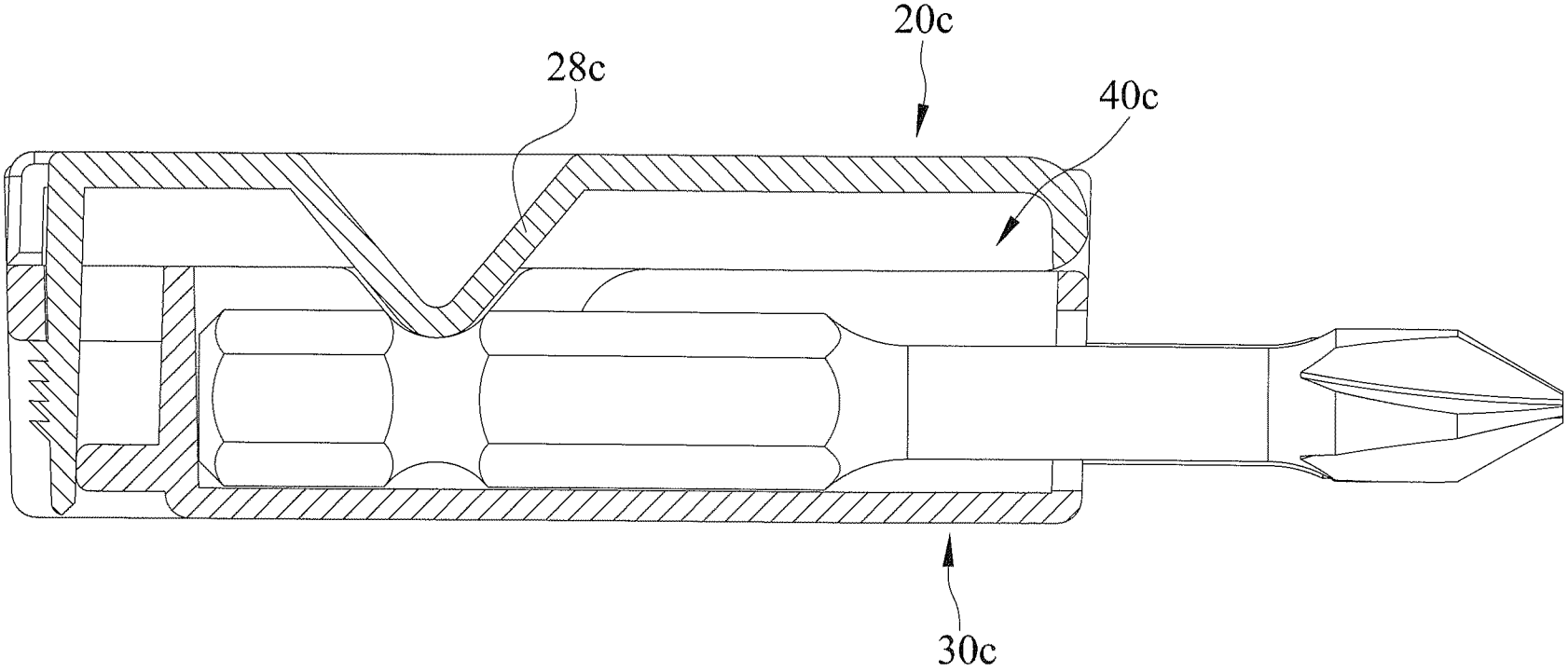
FIG. 14 is a cross-sectional view taken along line 14-14 of FIG. 12.

FIGS. 12 through 14 show a tool holder 10*c* preventing being dismantled from a tool in accordance with a fourth embodiment of the present invention, and same numbers are used to correlate similar components of the first embodiment, but bearing a letter c. The tool holder 10*c* includes the first and second holding members 20*c* and 30*c* incorporable to form a holding space 40*c*. The first holding member 20*c* has first and second sides 24*c* and 25*c* extending between first and second ends thereof. The second holding member 30*c* has first and second sides 34*c* and 35*c* extending between first and second ends thereof. The tool holder 10*c* is similar to the tool holder 10, except that the first holding member 20*c* has a shape different from that of the first holding member 20, and the second holding member 30*c* has a shape different from that of the second holding member 30. The tool holder 10*c* includes the first and second holding members 20*c* and 30*c* pivotally connecting to one another. The first holding member 20*c* includes two pivots extending therefrom and the second holding member 30*cs* includes two notches adapted to pivotally receive the two pivots respectively. The first holding member 20*c* includes a restraining projection 28*c* extending therefrom. The second holding members 30*c* includes at least one holding compartment 39*c*. The at least one holding compartment 39*c* in the second holding members 30*c* extends through the second sides 35*c* thereof. The tool holder 10*c* in the first arrangement thereof includes the restraining projection 28*c* facing and extending toward the holding compartment 39*c*, and the holding compartment 39*c* disposed within the holding space 40*c*.

In view of the forgoing, the first and second holding members 20, 20*a*, 20*b*, 20*c*, 30, 30*a*, 30*b*, and 30*c* are engaged with one another in the same way when the tool holders 10, 10*a*, 10*b*, and 10*c* are in the first arrangement thereof. When the tool holder 10 is used to hold a tool 90, the tool 90 is received in the holding space 40 and is constrained to the first and second holding recesses 23 and 33 to avoid shaking relative to the first and second holding members 20 and 30. The tool 90 is an extension drive. The first and second holding members 20 and 30 don't disengage from one another accidentally unless the second limiting structures 362 and 372 are cut short or off, thereby providing the tool holder 10 with an effective anti-theft effect. Similarly, when the tool holder 10*a* is used to hold a tool 90*a*, the tool 90*a* is received in the holding space 40*a* and is constrained to the first and second holding recesses 23*a* and 33*a* to avoid shaking relative to the first and second holding members 20*a* and 30*a*. The tool 90*a* is a wrench. Similarly, when the tool holder 10*c* is used to hold a tool 90*c*, the tool 90*c* is received in the holding space 40*c* and is constrained to the holding compartment 39*c* to avoid shaking relative to the first and second holding members 20*c* and 30*c*. The tool 90*c* is a bit. In addition, the tool holder 10*c* in the first arrangement thereof includes the restraining projection 28*c* abutting the tool 90*c* to help the tool 90 securely engage in the at least one holding compartment 39*c*. The tool holder 10*c* abuts the tool 90*c* in a direction preventing the tool 90*c* from being pulled out of the tool holder 10*c*.

The foregoing is merely illustrative of the principles of this invention, and various modifications can be made by those skilled in the art without departing from the scope and spirit of the invention.

What is claimed is:

1. A tool holder comprising:

a first holding member having first and second ends and first and second sides extending between the first and second ends thereof, with the first holding member including at least one restraining protrusion adjacent to the first side of the first holding member and having a fixed end fixed to the first holding member and a free end opposite the fixed end, with the at least one restraining protrusion including a first edge thereof defining a first restraining side with a first hooking structure having a first height and a second edge thereof opposite the first edge defining a second restraining side, with the first hooking structure including at least one first tooth; and a second holding member incorporable with the first holding member to form a holding space, with the second holding member having first and second ends and first and second sides extending between the first and second ends of the second holding member, with the second holding member including at least one catching slot adapted to engage with the at least one restraining protrusion, with the at least one catching slot including a first edge thereof including a first limiting structure having a second height and a second edge thereof opposite the first edge of the at least one catching slot and including a second limiting structure, with the second limiting structure extending from the second edge of the at least one catching slot having a free end spaced from the second edge of the at least one catching slot, with the second limiting structure being cuttable from the second edge of the at least one catching slot, with the first limiting structure including a ridge; wherein the first and second holding members in a first arrangement include:

the holding space formed therebetween with the first and second holding members prevented from being separated from one another, the first sides of the first and second holding members connected together and the second sides of the first and second holding members connected together, the first and second holding members include the ridge engaging with the at least one first tooth, the at least one restraining protrusion engaging in the at least one catching slot, the first hooking structure engaging with the first limiting structure, the second restraining side and the second limiting structure having a gap tolerance therebetween not greater than the first and second heights, the free end spaced from the second edge of the at least one catching slot with the gap tolerance, and the first hooking structure of the at least one restraining protrusion disengaging from the first limiting structure when the second limiting structure is cut from the at least one catching slot.

2. A tool holder comprising:

a first holding member having first and second ends and first and second sides extending between the first and second ends thereof, with the first holding member including at least one restraining protrusion adjacent to the first side of the first holding member and having a fixed end fixed to the first holding member and a free end opposite the fixed end, with the at least one restraining protrusion including a first edge thereof defining a first restraining side with a first hooking structure having a first height and a second edge thereof opposite the first edge defining a second restraining side, wherein the first hooking structure includes a plurality of first teeth; and a second holding member incorporable with the first holding member to form a holding space, with the second holding member having first and second ends and first and second sides extending between the first and second ends of the second holding member, with the second holding member including at least one catching slot adapted to engage with the at least one restraining protrusion, with the at least one catching slot including a first edge thereof including a first limiting structure having a second height and a second edge thereof opposite the first edge of the at least one catching slot and including a second limiting structure, with the second limiting structure extending from the second edge of the at least one catching slot having a free end spaced from the second edge of the at least one catching slot, with the first limiting structure including a ridge, and wherein the first and second holding members in the first arrangement thereof include:

the holding space formed therebetween with the first and second holding members prevented from being separated from one another, the first sides of the first and second holding members connected together and the second sides of the first and second holding members connected together, the ridge protruding and disposed in a gap between two adjacent first teeth of the plurality of first teeth, the first and second holding members include the ridge engaging with one of the plurality of first teeth, the at least one restraining protrusion engaging in the at least one catching slot, the first hooking structure engaging with the first limiting structure, the second restraining side and the second limiting structure having a gap tolerance therebetween not greater than the first and second heights, and the free end spaced from the second edge of the at least one catching slot with the gap tolerance.

3. The tool holder as claimed in claim 2, wherein the plurality of first teeth is disposed one after another along a longitudinal direction of the first restraining side, and wherein the fixed end and the free end of the first restraining side are distal from one another in the longitudinal direction of the first restraining side.

4. The tool holder as claimed in claim 2, wherein the first height is measured between top and bottom lands of each of the plurality of first teeth, with the bottom land of each of the plurality of first teeth disposed on the first edge of the first restraining side and distal to the top land of each of the plurality of first teeth, and wherein the second height is measured between a top and a root of the ridge, with the root of the ridge disposed on the first edge of the at least one catching slot.

5. The tool holder as claimed in claim 1, wherein the first height equals the second height.

6. The tool holder as claimed in claim 4, wherein the first height equals the second height.

7. The tool holder as claimed in claim 2, wherein the second limiting structure includes a protuberance including the free end, with the protuberance capable of being cut intermediate the free end and the second edge of the at least one catching slot.

8. The tool holder as claimed in claim 1, wherein the at least one restraining protrusion includes another restraining protrusion adjacent to the second side of the first holding member, and wherein the at least one catching slot includes another catching slot adapted to engage with the other restraining protrusion adjacent to the second side of the first holding member.

9. The tool holder as claimed in claim 1, wherein the first and second holding members pivotally connect to one another.

10. The tool holder as claimed in claim 9, wherein the second side of the first holding member and the second side of the second holding member include an extension extending therebetween, and wherein the extension allows the first holding member to pivotally connect to the second holding member.

11. The tool holder as claimed in claim 9, wherein one of the first and second holding members includes two pivots extending therefrom and another of the first and second holding members includes two notches adapted to pivotally receive the two pivots respectively.

12. The tool holder as claimed in claim 1, wherein the first holding member includes at least one first holding recess, wherein the second holding member includes at least one second holding recess incorporable with the at least one first holding recess, and wherein the first and second holding members in the first arrangement thereof include the first and second holding recesses thereof incorporating together and delimiting a holding compartment disposed within the holding space.

13. The tool holder as claimed in claim 1, wherein one of the first and second holding members includes at least one holding compartment, and wherein the first and second holding members in the first arrangement thereof include the holding compartment disposed within the holding space.

14. The tool holder as claimed in claim 13, wherein another of the first and second holding members includes a restraining projection extending therefrom, and wherein the first and second holding members in the first arrangement thereof include the restraining projection facing and extending toward the holding compartment.

15. The tool holder as claimed in claim 12, wherein the at least one first holding recess extends through the first and second ends of the first holding member, and wherein the at least one second holding recess extends through the first and second ends of the second holding member.

16. The tool holder as claimed in claim 13, wherein the at least one holding compartment in one of the first and second holding members extends through one of the first and second sides thereof.

17. The tool holder as claimed in claim 1 further comprising a hanging structure disposed on one of the first and second holding members.

18. The tool holder as claimed in claim 1, wherein the first holding member includes a first surface extending between the first and second ends thereof and between the first and second sides thereof, wherein the second holding member includes a second surface extending between the first and second ends thereof and between the first and second sides thereof, wherein the first and second surfaces have substantially equal dimensions, and wherein the first and second holding members in the first arrangement thereof include the first surface opposite the second surface.

19. The tool holder as claimed in claim 17, wherein the first holding member includes a first surface extending between the first and second ends thereof and between the first and second sides thereof, wherein the second holding member includes a second surface extending between the first and second ends thereof and between the first and second sides thereof, wherein the second surface has a greater area than the first surface, and wherein the first and second holding members in the first arrangement thereof include the first surface opposite the second surface.

20. The tool holder as claimed in claim 1, with the second holding member having a surface extending between the first and second ends and the first and second sides, with the at least one catching slot extending in the surface and in one of the first and second sides, with the second height extending parallel to the surface, with the second limiting structure extending from the second edge of the at least one catching slot parallel to the surface.

* * * * *